United States Patent [19]

Fournier

[11] 4,244,110

[45] Jan. 13, 1981

[54] WORKPIECE END LOCATOR

[75] Inventor: Roger H. Fournier, Millbury, Mass.

[73] Assignee: The Warner & Swasey Company, Cleveland, Ohio

[21] Appl. No.: 926,503

[22] Filed: Jul. 20, 1978

[51] Int. Cl.[3] ..... B24B 49/00

[52] U.S. Cl. ..... 33/180 R; 33/181 R; 33/174 L; 33/1 PT; 51/165 R

[58] Field of Search ..... 33/180 R, 169 R, 181 R, 33/185 R, DIG. 2, DIG. 5, 1 PT, 1 BB, 1 N, 1 M, 1 MP, 174 L; 51/165 R, 165.75

[56] References Cited

U.S. PATENT DOCUMENTS

| | | | |
|---|---|---|---|
| 3,663,189 | 5/1972 | Koide | 51/165 R |
| 3,688,444 | 5/1972 | Uhtenwoldt et al. | 51/165 R |
| 3,855,734 | 12/1974 | Fournier | 51/165 R |
| 3,944,798 | 3/1976 | Eaton | 33/1 M |

*Primary Examiner*—Willis Little

*Attorney, Agent, or Firm*—Howard G. Massung; Ronald B. Brietkrenz

[57] ABSTRACT

A workpiece end locator which provides a linear analog voltage indicative of the workpiece location relative to a reference plane. The output of the end locator can be utilized for positioning the workpiece at a desired location or for providing position information to the machine control system which will automatically compensate for the workpiece position. The disclosed end locator utilizes a rotatable shaft having a probe arm extending from one end thereof. A probe tip on the probe arm contacts the workpiece whose position is being detected. A rotary transducer is connected to the other end of the rotatable shaft for providing a linear analog signal representative of the angular shaft position. A pair of stops are provided between which the rotatable shaft can rotate. A pair of air actuators are provided, one of which biases the rotatable shaft toward one stop and the other biases the rotatable shaft toward the other stop. A spring loaded latch, which can be manually disengaged, is provided for engaging and holding the rotatable shaft at a zero reference point between the pair of stops.

12 Claims, 8 Drawing Figures

WORKPIECE END LOCATOR

BACKGROUND OF THE INVENTION a. Field of the Invention

This invention relates to workpiece locators and more particularly to an end locator which provides a linear indication of workpiece position over a selected range.

b. Description of the Prior Art

Endwise locating of a workpiece which may be used for automatic positioning is known in the prior art. U.S. Pat. Nos. 2,984,953; 3,663,189; 3,694,970; and 3,855,734 shows various workpiece locators.

Automatic endwise locating of a workpiece has in the past normally been accomplished by a sliding spindle headstock in combination with a swivel table mounted probing mechanism or by an oil motor driven sliding table in combination with a base mounted probing mechanism. In each of these prior art systems the workpiece location is established by actuation of a limit switch at the desired workpiece location. With these types of location systems, where the workpiece position is determined by a limit switch, there is no need to accurately measure the initial workpiece offset. Extended and/or offset probes can be used to overcome table or workpiece interferences without any regard for the effect on the accuracy of measurement since repeatability of the limit switch actuation is the major concern. Because of this, flexibility is provided in the probe construction and it can be custom designed to suit the particular application.

SUMMARY OF THE INVENTION

The disclosed invention teaches a workpiece end locator which provides a linear position indication over its range of operation. The disclosed end locator is particularly suitable for use on a grinding machine as disclosed in copending U.S. Pat. No. 4,115,967 whose teaching is hereby incorporated by reference.

The disclosed end locator which engages a workpiece comprises a movable elongated main shaft whose movement is limited by the workpiece; a first stop disposed to limit movement of the shaft in one direction; a second stop disposed to limit movement of the shaft in the other direction, confining the shaft to movement between the first and second stops; a first biasing means for biasing the shaft toward the first stop when activated; a second biasing means for biasing the shaft toward the second stop when activated; and a transducer connected to the shaft to provide a position indication of the shaft over its range of movement. A spring loaded latch is provided for holding the shaft at a selected reference position intermediate the first and second stops. The latch can be manually positioned in an unlatched position. A bracket is provided for supporting the end locator from a machine on which it is used. A quick clamp attachment is provided on the bracket for easy positioning of the locator at a desired position on the machine. A probe arm, which is connected to the main shaft, has a tip which engages the workpiece. Position adjusting means are provided for adjusting the position of the probe arm at a desired position to detect workpieces of different sizes and configurations.

The elongated main shaft which supports the probe arm at one end can be supported for rotary movement about its longitudinal axis. The transducer, which provides the workpiece position information, can be a rotary variable differential transformer connected to the main shaft end opposite the probe arm. A housing is provided which supports the elongated shaft and is in turn supported on a fixed pivot pin which extends between the bifurcations of the machine ataching bracket. A set screw is provided for fixing the position of the support housing with respect to the bracket. Preferably a pair of pneumatic cylinders provide the biasing for the elongated shaft toward the first or second stops. By interchanging the air connections to the pair of penumatic actuators the direction in which the locator senses a workpiece can be reversed. That is, depending on the air connections, the locator can be either a right-hand end locator or a left-hand end locator.

The spring biased latch is provided on the support housing for engaging a slot in the rotatable shaft to hold the probe arm in a desired reference position. Normally, the latch will hold the probe arm in a vertical upright position, which is indicative of zero offset. The spring loaded latch can be manually set at an inoperative position.

The output of the end locator can be used either to reposition the workpiece or to provide compensation for the machine control system to properly operate on the workpiece. In a machine as disclosed in U.S. Pat. No. 4,115,967 the most convenient way to accomplish end location is to accurately measure the amount and direction of workpiece position error and then use this error to digitally offset the table position servo, thus providing the desired compensation. The workpiece offset compensation is then removed at the completion of each workpiece cycle. Providing offsetting compensation for operation of the machine requires a probe mechanism that is relatively accurate over its intended range of measurement. This requirement limits the flexibility to custom design the probe to suit various applications. The disclosed probe provides the desired output and is flexible enough to satisfy a wide variety of part and position requirements.

The disclosed end locator is also useful on a machine in which the workpiece is located or moved to a reference plane relative to the machine. In this case, the end locator can be used to establish a workpiece location relative to a table, where repeatability to a position is important and the accuracy over the measuring range can be used to permit offsetting from the zero reference by means of a computer. In this embodiment the workpiece is moved slowly until the probe arm moves to a vertical upright zero reference position. When the zero position is reached, movement of the workpiece is stopped with the workpiece at the desired zero reference position.

It is an object of this invention to teach a workpiece end locator which can be utilized for a variety of applications, and which provides a linear indication of workpiece position over its range of movement.

It is a further object of this invention to teach an end locator which can be used to compensate the machine controls for offset of the workpiece from a reference point or which can be used for positioning a workpiece at a desired reference point.

BRIEF DESCRIPTION OF THE DRAWINGS

For a better understanding of the invention, reference may be had to the preferred embodiment exemplary thereof shown in the accompanying drawings in which.

DETAILED DESCRIPTION OF THE PREFERRED EMBODIMENT

Figure 1:
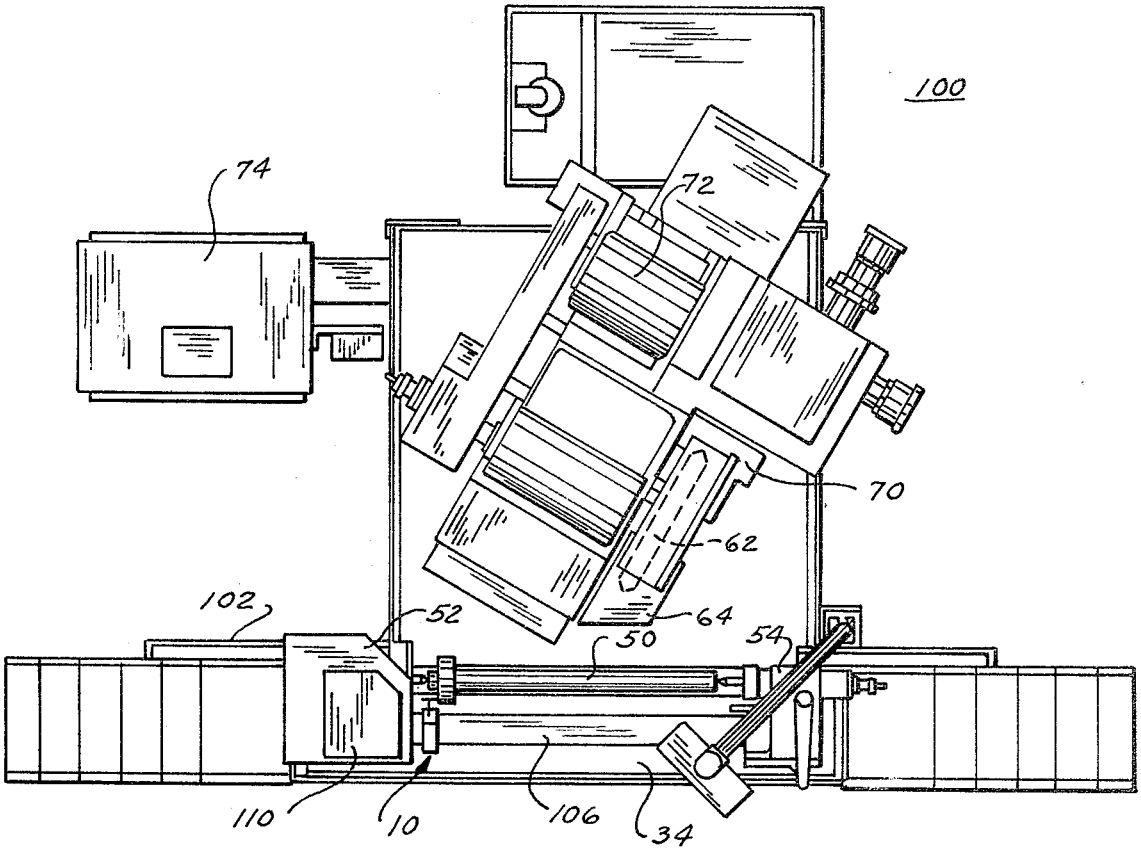
FIG. 1 is a plan view of a grinding machine utilizing the disclosed end locator.

Referring now to the drawings and FIG. 1 in particular, there is shown a grinding machine 100 utilizing an end locator 10 constructed in accordance with the teachings of the present invention. Grinding machine 100, which is more fully described in copending U.S. Pat. No. 4,115,967 includes a base upon which a movable workpiece carriage or table 34 is mounted. A drive motor is operable to rotate a drive screw to effect movement of the table 34 along a pair of parallel ways (not shown). The drive screw and ways are enclosed by guards which are telescopically movable to accomodate movement of the carriage 34 relative to the vase 102.

A workpiece 50 is rotatably supported on a swivel table 106 by a headstock 52 and a tailstock 54. The workpiece 50 is supported by the headstock 52 and tailstock 54 for rotation about its longitudinal axis. The axis of rotation of the workpiece 50 normally extends parallel to the drive screw and the longitudinally extending ways. Therefore, upon operation of the table drive motor, table 34 is moved along its ways to move the workpiece 50 along its longitudinal axis of rotation.

A workpiece drive motor 110 is connected with the headstock 52 and is effective to rotate the workpiece 50 about its longitudinal axis. A circular grinding wheel 62 which is partially enclosed by a wheel guard 64 is supported for rotation about an axis which extends at some angle to the axis of rotation of the workpiece 50. The grinding wheel 62 is rotatably mounted on a carriage 70 which is movable toward and away from the workpiece 50 along parallel guide tracks which extend at some angle to the axis of rotation of workpiece 50. A drive motor through an appropriate ball screw arrangement positions the grinding wheel carriage 70. The grinding wheel drive motor 72 mounted on carriage 70 rotates the grinding wheel about its central axis.

A computer 74 is provided to control operation of grinding machine 100. Computer 74 is connected to receive inputs from a control panel and various sensors on grinding machine 100. Inputs from the various sensors on grinding machine 100 are supplied to computer 74 and used in controlling operation of grinding machine 100. End sensor 10 provides workpiece position information to computer 74 which utilizes it to compensate for the workpiece offset from the reference point.

For the machine 100, the X axis extends horizontally in a direction perpendicular to the Z axis, which extends between the headstock 52 and the tailstock 54. Prior to initiating a grinding operation, it is necessary to locate the workpiece 50 in a predetermined axial position relative to the X axis. This has previously been done by shifting the workpiece along the Z axis, which coincides with the longitudinal axis of the workpiece 50, until a preselected reference surface is precisely located in a reference plane. Of course, if the workpiece is not located with the reference surface exactly in the reference plane, the workpiece will not be properly located relative to the X axis, and this can result in errors during the grinding operation.

Utilizing the end locator of the present invention, the necessity of locating the reference surface on the workpiece exactly in a reference plane is eliminated. In accordance with the present invention, the reference surface on the workpiece need only be located closely adjacent to the reference plane. Probe 10 provides an output signal whose magnitude varies as a function of the distance which a reference surface on workpiece 50 is offset from the machine reference plane. The reference plane of machine 100 may be located to the left or the right of reference surface on workpiece 50.

The end locator 10 includes a probe arm 12 having a tip 11 which engages an annular reference surface on workpiece 50. When the workpiece reference surface is exactly aligned with the machine zero reference plane a zero voltage output signal is supplied by locator 10 when it engages the workpiece. If the workpiece reference surface is offset from the machine reference plane the output voltage from probe 10 is of a magnitude and polarity to indicate the distance and direction of the offset. The output voltage from end locator 10 is fed to an analog to ditigal converter whose digital output indicates the direction and amount of offset. The digital output from the analog to digital converter is utilized by computer 74 to offset the table position servo to compensate for the workpiece offset. That is, the output from the analog to digital converter causes the data stored in the computer 74 to indicate the correct position of grinding wheel 62 relative to the workpiece 50 regardless of the offset of workpiece 50 from the machine reference plane.

Referring not to FIGS. 2 through 6, there is shown an end locator 10 constructed in accordance with the present invention. End locator 10 is clamped to swivel table 106 which extends along table 34. Locator 10 includes a rotatable shaft 14 having probe arm 12 extending from one end thereof. Coupled to the other end of rotatable shaft 14 is an analog output transducer 16 which provides an analog indication of the angular position of shaft 14. Transducer 16 can be a Pickering Rotary Variable Differential Transformer Model 23330-Y2-F0. Transducer 16 is connected to the end of shaft 14 by an appropriate coupling 18. A housing 20 is provided around a portion of shaft 14 and transducer 16. Shaft 14 is supported by appropriate bearings for rotary movement within housing 20.

A bracket 22 is provided on end locator 10 for connecting to swivel table 106. Bracket 22 includes a toggle clamp 24 for making a qucik connection to swivel table 106. Toggle clamp 24 can be a standard variety such as manufactured by DE-STA Co. Toggle Clamp Model No. 602. Bracket 22 includes a bifurcated portion with a pivot pin 26 disposed between the bifurcations. Pivot pin 26 is locked against rotation by set screws in the top of the bifurcations which engage flat portions formed on pivot shaft 26.

Housing 20 is supported on pivot pin 26 for pivotal movement therearound. A retaining screw 28 is provided in the side of one of the bifurcations of bracket 22 for engaging a downward projecting portion of housing 20. Retainer 28 can be used for eliminating relative movement of housing 20 with respect to bracket 22. Locator 10 is constructed so that probe arm 12 is limited to approximately a 35° angular move in either direction from its vertical upright position. As can best be seen in FIG. 8, shaft 14 has a slot 30 formed therein. Slot 30 is aligned with probe arm 12. That is, slot 30 is disposed on the same radius defined by probe arm 12 with respect to the longitudinal axis of main shaft 14. A spring loaded latch 32 which can engage slot 30 to hold probe arm 12 in a zero reference vertical position is formed on housing 20. Spring 35 urges latch 32 downward into engagement with slot 30. A top knob 36 is connected to latch 32 and can be used for raising and holding latch 32 out of engagement with slot 30. Knob 36 when rotated through 90 degrees locks latch 32 in an up position out of engagement with slot 30.

Figure 6:
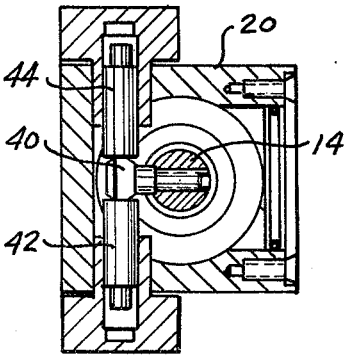
FIG. 6 is a section view of the end locator shown in FIG. 2 along the line VI—VI.

As can best be seen in the section view of FIG. 6, rotatable shaft 14 has a positioning stud 40 extending perpendicular therefrom. A pair of pneumatic biasing cylinder 42 and 44 are provided for biasing positioning stud 40 and rotatable shaft 14 in a desired direction. Air actuators 42 and 44 have the air supply connected thereto for providing for proper locator 10 operation. The side of locator 10 on which a workpiece can be sensed is reversed by reversing the air connected to actuators 42 and 44.

Probe arm 12 is positionable along rotatable shaft 14. A plurality of connecting openings are formed in probe 12 and rotatable shaft 14 for changing the probe arm position. Locator 10 thus is very flexible in where the tip 11 which contacts workpiece 50 can be located. The entire locator can be moved along swivel table 106 to move into proximity to the desired location. Shaft 14 can be pivoted around pin 26, and probe arm 12 can be moved along shaft 14 to provide contact by tip 11 at the desired position.

Figure 2:
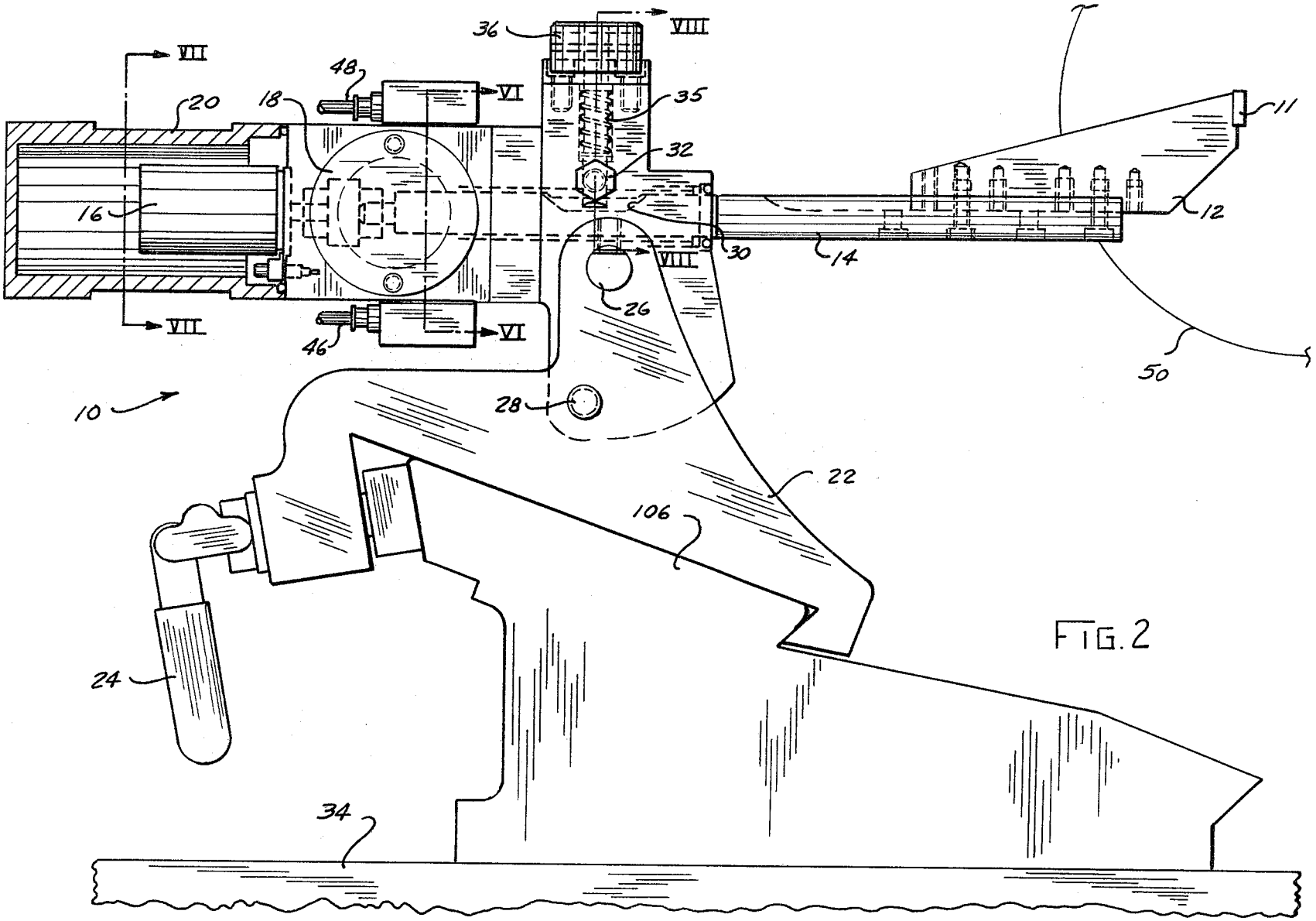
FIG. 2 is an enlarged view partially in section showing a side view of the end locator shown in FIG. 1.
Figure 3:
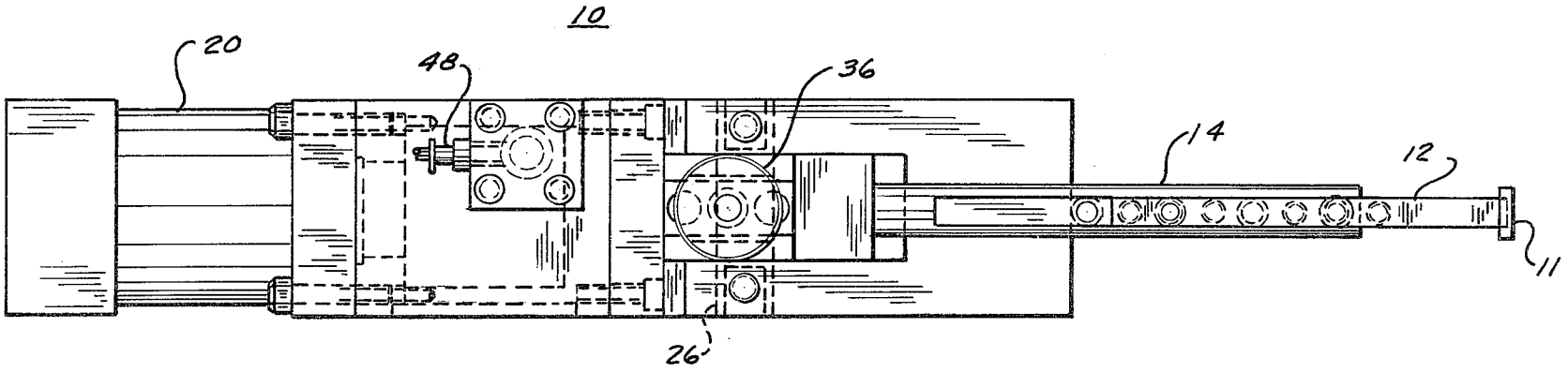
FIG. 3 is a top view of the end locator shown in FIG. 2.
Figure 4:
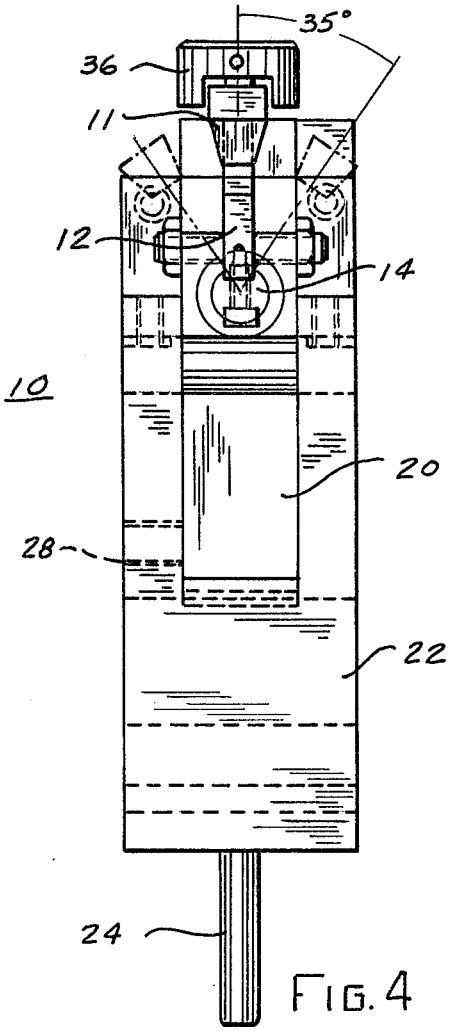
FIG. 4 is a right-end view of the end locator shown in FIG. 2.
Figure 5:
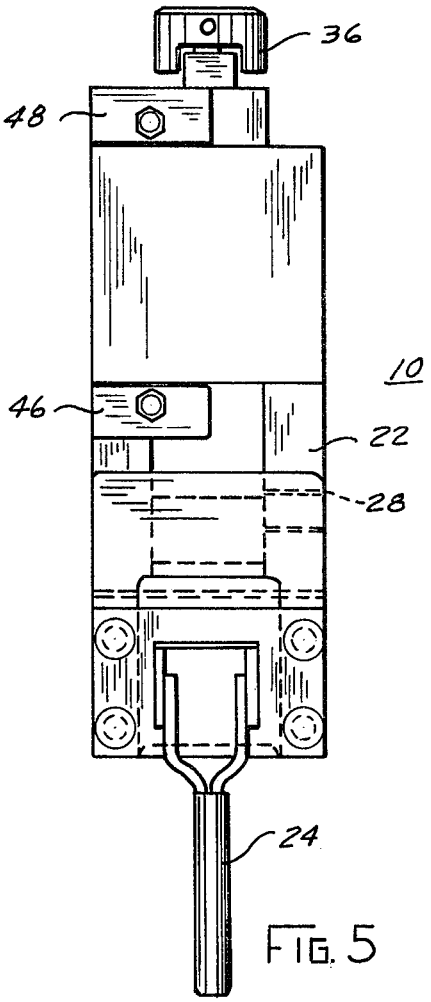
FIG. 5 is a left-end view of the end locator shown in FIG. 2.
Figure 7:
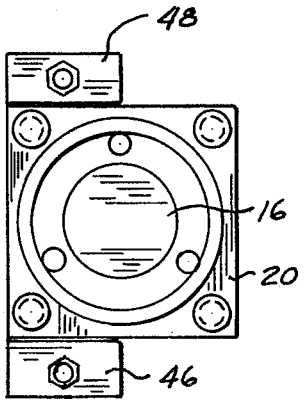
FIG. 7 is a section view of the end locator shown in FIG. 2 along the line VII—VII; and, FIG. 8 is a section view of the end locator shown in FIG. 2 along the line VIII—VIII.
Figure 8:
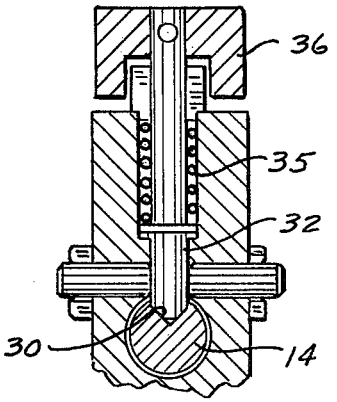

FIG. 7 which is a view along line VII—VII of FIG. 2 shows the transducer 16 and air connection ports 46 and 48 which communicate with air actuators 42 and 44 respectively. FIG. 8 which is a section view along VIII—VIII of FIG. 2 shows latch 32 engaging the slot in shaft 14 to vertically align probe arm 12. Knob 36 when raised and rotated locks latch 32 out of engagement with shaft 14.

In a grinding machine 100 the most convenient way to accomplish end workpiece location is to utilize end locator 10 to measure the amount and direction of workpiece position error and to digitally offset the table position servo to compensate. Table offset is removed at the completion of grinding on each part. During set up, the probe arm 12 is locked in a vertical position and locator 10 is slid on swivel table 106 until the probe tip 11 contacts the shoulder from which the workpiece location is to be taken. Bracket 22 is then clamped to the table and air pressure lines are connected to the air actuator cylinder ports to give the correct direction of operation. When the locator 10 is contacting the workpiece shoulder from which the location is to be taken, knob 36 is positioned to raise latch pin 32, and to release rotatable shaft 14. Rotatable shaft 14 then moves out of engagement with workpiece 50 due to the bias from actuator 42 or 44 until it engages a mechanical stop. The control panel for machine 100 includes a probe pushbutton which can be utilized to move probe tip 11 into engagement with the shoulder of workpiece 50. Through appropriate valving arrangements air connections are made to air actuators 42 and 44 to move probe tip 11 into engagement with the workpiece 50. Appropriate interlocks are provided so that the probe arm 12 will not be moved into engagement with the workpiece if the workpiece is rotating or if the initial retracted probe position is less than 0.050 inches. If the initial retracted probe position is less than 0.050 inches from the zero vertical position, a probe light will flash indicating a fault exists. The fault may be that the latch pin is not released, the probe mechanism is not properly positioned, the air pressure lines are reversed, or an interference is restricting the probe motion.

When the probe tip 11 engages the workpiece shoulder it will remain in contact and the probe light will be on only if the contact positiion within ±0.010 inches of the zero reference position. If these conditions are not met, the probe will retract immediately and the end locator must be repositioned. During operation, the probe can be retracted by actuating the probe pushbutton a second time. The location of the initial rough shoulder position, including the setup error, is measured and stored in computer 74 for reference in automatic cycling. A piece can then be ground to establish finished diameter and shoulder dimensions using offsets to achieve tolerance if necessary. At this point, the machine is ready for an automatic cycle operation.

During an automatic cycle operation, the end locator engages the reference shoulder automatically at a programmed sequence in the grinding cycle. A fault is indicated by a flashing probe light and will occur only if the rough part probe position is greater than 0.050 inches from the theoretical zero position. Computer 74 compares each new probe reading with the manually established initial reading and uses the differences to offset the Z axis register for each of the table positions programmed. Transducer 16 is preset to zero output with the probe arm 12 locked into vertical probing position at the time of assembly.

Disclosed locator 10 can also be used with a grinding machine having a sliding headstock spindle for moving the workpiece to a desired reference plane. In this embodiment the headstock spindle moved the workpiece rapidly to an extreme position. The probe then engages a workpiece reference shoulder from which a location is taken. The headstock spindle then moves the workpiece slowly back until the probe reaches a zero vertical position. The provided accuracy over the measuring range enables the output of indicator 10 to be used, through a computer, to compensate for an offset of the workpiece from the zero reference.

It can thus be seen that the disclosed end locator 10 can be utilized in either moving the workpiece to desired reference plane or in compensating the machine controls to correct for the workpiece offset from the machine reference plane. The disclosed end locator 10 can be used for either right or left hand operation and provides great flexibility in positioning of sensing tip 11.

I claim:

1. An end locator for locating a workpiece in a machine comprising:

a probe arm rotatable about an axis through a selected angular range;

a first stop;

a second stop displaced from said first stop with said probe arm disposed angularly therebetween to define the selected angular range;

a shaft securely connected to said probe arm and extending along the axis around which said probe arm rotates;

a rotary transducer connected to said shaft to provide an analog signal representative of the position of said shaft;

first biasing means, positioned to one side of said shaft and comprising said second stop, for biasing said probe arm toward said first stop when activated into contact with either the workpiece or said first stop;

second biasing means, positioned to the other side of said shaft and comprising said second stop, for biasing said probe arm twoard said first stop when activated into contact with either the workpiece or said first stop;

second biasing means, positioned to the other side of said shaft and comprising said first stop, for biasing said probe arm toward said second stop when activated into contact with either the workpiece or said second stop; and, a spring loaded latch movable to a latched position engaging and latching said shaft to hold said probe arm at a zero reference position, intermediate said first stop and said second stop, and an unlatched position out of engagement with said shaft, permitting free rotation of said probe arm.

2. A locator as claimed in claim 1 wherein:

said first biasing means comprises a pneumatic cylinder;

and said second biasing means comprises a pneumatic cylinder.

3. An end locator as claimed in claim 2 wherein said rotary transducer comprises a rotary variable differential transformer.

4. An end locator as claimed in claim 1 comprising:

a housing supporting said probe arm, said shaft, said rotary transducer, said first stop, said second stop, said first biasing means, and said second biasing means;

a bifurcated bracket having a fixed pivot pin with said housing supported for pivotal movement therearound; and a fastener for securing said housing with respect to said bracket.

5. An end locator as claimed in claim 4 comprising:

a quick disconnect toggle clamp attached to said bracket for attaching said bracket to a machine.

6. An end locator as claimed in claim 5 wherein:

said probe arm is attachable at a plurality of positions to said shaft.

7. An endwise locator for providing an indication of a workpiece position in a machine comprising:

a shaft supported for rotary movement about its longitudinal axis;

a rotary transducer for providing an analog output indication of the angular position of said shaft connected to one end of said shaft;

a probe arm attached to the other end of said shaft and extending radially outward from said shaft;

a first stop associated with said shaft for limiting rotary movement of said shaft;

a second stop associated with said shaft spaced apart from said first stop for limiting rotary movement of said shaft and in association with said first stop defining the range of angular movement of said shaft;

a first air actuator disposed to one side of said shaft which with air pressure applied thereto biases said shaft toward said first stop causing either said probe arm to engage the workpiece or said shaft to engage said first stop;

a second air actuator disposed to the other side of said shaft which with air pressure applied thereto biases said shaft toward said second stop causing either said probe arm to engage the workpiece or said shaft to engage said second stop; and, a latch movable to a first position, securely latching said shaft between said first and second stops to hold said probe arm at a zero reference position, and a second position, unlatching said shaft and permitting free rotation of said probe arm.

8. A locator as claimed in claim 7 comprising:

a bracket a pivot pin disposed on said bracket;

a housing supporting said shaft and connected to said pivot pin for pivotal movement therearound; and, a retaining screw for engaging said housing and said bracket to limit relative movement.

9. A locator as claimed in claim 8 wherein the position of said probe arm is adjustable on said shaft.

10. A workpiece locator for attaching to a machine comprising:

an elongated shaft which is movable;

a first stop disposed to limit movement of said shaft in one direction;

a second stop disposed to limit movement of said shaft in the other direction so that said shaft is movable between said first and second stops;

first pneumatic biasing means associated with said shaft for biasing said shaft toward said first stop when activated into contact with the first stop or the workpiece;

second pneumatic biasing means associated with said shaft for biasing said shaft toward said second stop when activated into contact with the second stop or the workpiece;

a rotary transducer connected to said shaft for providing an analog position indication of said shaft; and, latching means movable to a latched position for engaging and holding said shaft at a zero reference position and to an unlatched position out of engagement with said shaft for permitting free movement of said shaft.

11. A workpiece locator as claimed in claim 10 comprising:

support means for supporting said shaft for rotary movement about its longitudinal axis;

a probe arm attached to one end of said shaft for engaging the workpiece and extending radially outward from the longitudinal axis of said shaft;

said transformer comprises a rotary variable differential transformer.

12. A locator as claimed in claim 11 comprising:

a bracket having a fixed pivot pin, for supporting said support means for pivotal movement therearound, and a toggle clamp, for quick connection of said bracket to the machine;

a retainer for securing said support means with respect to said bracket; and, said probe arm is positionable on said shaft.

* * * * *